US007956875B2

(12) United States Patent
Inuzuka et al.

(10) Patent No.: US 7,956,875 B2
(45) Date of Patent: Jun. 7, 2011

(54) DISPLAY DEVICE WHICH REDUCES VARIATION IN CHROMATICITY OF RED, BLUE, AND GREEN LEDS

(75) Inventors: Tatsuki Inuzuka, Mito (JP); Hiroki Kaneko, Hitachinaka (JP)

(73) Assignee: Hitachi Displays, Ltd., Chiba (JP)

( * ) Notice: Subject to any disclaimer, the term of this patent is extended or adjusted under 35 U.S.C. 154(b) by 1052 days.

(21) Appl. No.: 11/621,211

(22) Filed: Jan. 9, 2007

(65) Prior Publication Data

US 2007/0159448 A1 Jul. 12, 2007

(30) Foreign Application Priority Data

Jan. 10, 2006 (JP) ..... 2006-002521

(51) Int. Cl.
*G09G 5/10* (2006.01)
*G09G 3/36* (2006.01)

(52) U.S. Cl. ..... 345/690; 345/102

(58) Field of Classification Search ..... 345/87–89, 345/98–102, 204, 207, 690
See application file for complete search history.

(56) References Cited

U.S. PATENT DOCUMENTS

| | | | | |
|---|---|---|---|---|
| 6,570,611 | B1 * | 5/2003 | Satou et al. | 348/189 |
| 7,129,456 | B2 * | 10/2006 | Ioka et al. | 250/208.1 |
| 2005/0174342 | A1 * | 8/2005 | Maeyama et al. | 345/204 |

FOREIGN PATENT DOCUMENTS

| | | |
|---|---|---|
| CN | 1568017 A | 1/2005 |
| JP | 08-313789 | 11/1996 |
| JP | 2005-258404 | 9/2005 |
| JP | 2006-145798 | 6/2006 |

OTHER PUBLICATIONS

Office Action with mailing date of Aug. 22, 2008 (with translation).

* cited by examiner

*Primary Examiner* — Bipin Shalwala
*Assistant Examiner* — Keith Crawley
(74) *Attorney, Agent, or Firm* — Antonelli, Terry, Stout & Kraus, LLP.

(57) ABSTRACT

A display device configured to realize a high display quality by correcting irregularity, caused by a lighting unit, by signal processing. The target light quantity in a displayed image of the liquid crystal panel is set, the estimated light quantity at each pixel location in the plane of the backlight is calculated, matrix coefficients are calculated based on the estimated light quantity and the target light quantity, image signals are subjected to matrix operations using the matrix coefficients, and the liquid crystal panel is driven by image signals resulting from the matrix operations. Therefore, the light quantity distribution in the displayed image becomes identical to the target light quantity distribution.

9 Claims, 5 Drawing Sheets

DISPLAY DEVICE WHICH REDUCES VARIATION IN CHROMATICITY OF RED, BLUE, AND GREEN LEDS

BACKGROUND OF THE INVENTION

The present invention relates to a display device for image display by using a backlight and a liquid crystal display in combination.

A liquid crystal display as a display device is configured by combining a backlight and a liquid crystal panel. This backlight illuminates the liquid crystal panel in its whole area or in multiple divided segments. The liquid crystal panel has a structure having arranged in a plane a number of pixels with a function of transmittance control (or reflectance control) by liquid crystal elements, each pixel being provided with a color filter. As the liquid crystal panel is combined with a backlight, the liquid crystal panel becomes a display device capable of displaying color images.

The basic requirement of the backlight is to illuminate the liquid crystal panel uniformly, and the light emission characteristics, which contribute to uniform lighting, include wavelength distribution, luminance, full-width half maximum, and dominant wavelength. If some characteristics are not uniform, the rays incident on the liquid crystal panel are not uniform, and rays output from the liquid crystal panel under a control become irregular, resulting in deterioration of quality of the displayed image.

For example, when a fluorescent lamp is used as a backlight source, a fluorescent lamp has its light uniformity improved by a combined use of a white-light fluorescent lamp in a length close to the screen size and a scatter plate for optically scattering light rays emitted by the fluorescent lamp. Because a fluorescent lamp can be approximated by a line light source and its light emission is converted into a surface light source, a spatial passage or a volumetric capacity for mixing light rays is indispensable for the fluorescent lamp.

Recently, with the improvement in the performance of semiconductor light emitting devices, attempts have been made to use semiconductor light emitting devices as a light source for the backlight. Among semiconductor light emitting devices, there are LEDs (light emitting diodes) and LDs (laser diodes). Those semiconductor devices, such as LEDs and LDs, are different in properties from conventional fluorescent lamps in that an LED or an LD has a precipitous rise in their light emission wavelength distribution and that the LED or LD can be approximated by a point light source (the semiconductor chip size is small).

To use LEDs, which are point light sources, as a surface-light-source backlight, it is necessary to obtain wider scattering of light by LEDs than by a fluorescent lamp. If it is impossible to provide sufficient scattering of light, irregularity occurs on an image. When forming a backlight by arranging a large number of LED devices in one plane, it ought to be noted that the variation in characteristics among the devices and the irregularity caused by the optical structure are the factors that deteriorate display quality.

To suppress irregularity such as described, the use of a scatter plate to mix the light rays from the light emitting devices is effective; however, this contributes to an increase in volume of the device because it is necessary to secure an optical path for the light rays. To minimize the variation in characteristics among devices, it is effective to sort devices but this takes sorting instrument and time.

Shinpen Shikisai Kagaku (New-Edition Color Science) Handbook $2^{nd}$ Edition (compiled by The Color Science Association of Japan, published 1998/06 by Tokyo University Press) describes a method by which colors perceived by human visual sense are expressed by color signals in numeric form and also a method by which the irregularity in a displayed image on a display device is corrected by using color signals. This Handbook describes in detail the CIE 1931 XYZ calorimetric system established by CIE (International Commission on Illumination) in 1931 as a method for numerically quantifying colors by three kinds of color signals X, Y and Z based on human visual sense characteristics.

It is known that the human visual sense characteristics recognize a color image by a combination of color signals having at least three kinds of wavelength distribution, and that as the three kinds of color signals, red, green, and blue (RGB), or hue, saturation, and luminance (HSL), or XYZ are used.

The XYZ calorimetric system is a method for numerically expressing colors based on the human visual sense characteristics, and by this method, the visual sense characteristics expressed by three kinds of spectrum distribution can be replaced by three values X, Y and Z. By calculating chromaticity values, such as x y (low-case x and y) based on XYZ values, colors can be expressed numerically.

By using appropriate conversion equations, RGB or HSL are converted into XYZ signals. With any calorimetric system, at least three kinds of color signals are required to express colors based on human visual sense.

There has been proposed a method for realizing a uniform display quality on a displayed image on liquid crystal panel configured to control transmittance of light received from the backlight by adjusting display signals for transmittance control.

JP-A-8-313879 reveals a method for correcting irregular display factors of a display device by signal processing, the method having been developed with sights set on two characteristics, that is, the luminance and the hue on the display image.

However, the colors that the human eye perceives are represented by three kinds of signals as shown in the Color Science Handbook mentioned above. Therefore, if only the two kinds of characteristics are addressed in coping with irregular display image, it follows that one dimension of the human visual sense characteristics is missing. For example, in the three-dimensional calorimetric system of hue, saturation, and luminance (HSL), if coordinates are luminance and hue only, a coordinate for saturation is ignored here.

Problems to be solved by the present invention are described below. Firstly, when semiconductor light emitting devices are used as backlight sources, such as LEDs for example, since the LEDs may be referred to as point light sources if compared with a fluorescent lamp, their light quantity distribution varies notably. Among the individual LEDs, there are variations in characteristics, such as the peak wavelength (dominant wavelength) or the full width at half maximum of the emission wavelength distribution of the LED. Those variations give rise to differences of primary colors of the illumination, generating irregular color on a displayed image. If there is variation in the emission wavelength distribution (spectrum) of the LED, so long as only the luminance and the hue are used as correcting objects, sufficient correction cannot be obtained and irregular color cannot be eliminated.

Secondly, if one takes note of characteristics of signals supplied to a displayed image which is to be the target after correction has been made, generally, the center area of the displayed image tends to be light and the peripheral region dark for reasons of the optical structure. With the visual sense of a human being, we often gaze at the center area, so that it is desirable that the center area is lighter than the peripheral area. Despite this, if signals are corrected to make the luminance uniform over the whole displayed image, the signal correction process will take place to reduce the brightness of the center area in accordance with the darkness of the peripheral area. This suppresses the lighting unit's fundamental capacity of providing the brightness of the center area of the displayed image.

SUMMARY OF THE INVENTION

The present invention comprises a unit for setting target light quantity in a displayed image; a unit for calculating estimated light quantity of each pixel location in the displayed image; a unit for calculating a matrix coefficient based on the estimated light quantity and the target light quantity; and a matrix operation unit for computing video signals by using matrix coefficients.

The present invention corrects irregularity caused by the lighting unit by signal processing so that light quantity distribution in the displayed image becomes identical to a target light quantity distribution. This is effective in realizing a high display quality.

Other objects, features and advantages of the invention will become apparent from the following description of the embodiments of the invention taken in conjunction with the accompanying drawings.

DESCRIPTION OF THE INVENTION

Figure 1:
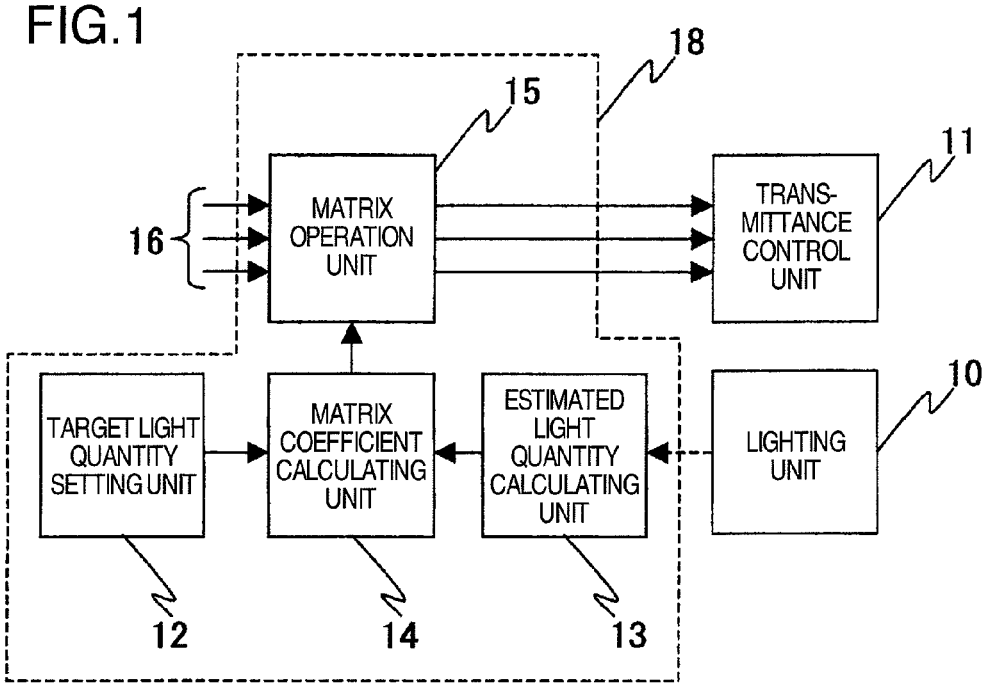
FIG. 1 is a basic block diagram of the present invention.

Embodiments of the present invention to carry out the present invention will be described below.

A display device comprises a backlight for surface lighting by using semiconductor light emitting devices, such as LEDs, and a liquid crystal panel having liquid-crystal-applied transmittance (or reflectance) control devices arranged in a plane. In this display device, the backlight and the liquid crystal panel are stacked together, and a display image is formed by controlling at each pixel the transmittance (or reflectance) of light quantity from the backlight to thereby correct the irregular luminance to improve display quality.

To clarify the structure and features of the present invention, the factors causing irregularity to occur in a displayed image will be described. To use LEDs for the backlight, signal processing is carried out by considering the (1) magnitude, (2) variation, and (3) changes (in the relation among temperature, elapsed time, driving voltage, current, and light emission characteristics).

With regard to (1) above, an LED is a semiconductor device formed by a semiconductor process and is similar to a point light source if it is compared with the size of the displayed image. Therefore, to form a backlight by LEDs, an optical structure is required to convert point light sources into a surface light source. If a plurality of LEDs are used, irregularity occurs in a light quantity distribution depending on locations where the LEDs are arranged.

With regard to (2) above, the characteristics of the LEDs as semiconductor devices vary across a wafer. The variation occurs in characteristics, such as luminance, dominant wavelength, temperature coefficient, and lifetime characteristic. Changes visually perceptible of variation of those characteristics can be measured as changes in chromaticity, for example.

With regard to (3) above, the variation characteristics of the LEDs, which are semiconductor devices, change with operating conditions, as exemplified by changes in luminance and dominant wavelength that change with temperature and changes in luminance that change with operation cumulative time. Visually perceptible deterioration in image quality caused by variations such as mentioned above can be quantified as changes in chromaticity.

A feature of the present invention is that irregularity on a displayed image caused by the factors enumerated above is corrected by signal processing. To this end, the display device comprises a unit for calculating an estimated light quantity distribution on an actual backlight and a unit for setting a target light quantity to be achieved by irregularity correction to thereby correct display signals for the liquid crystal panel to change reality to reach a target.

The estimated light quantity of the backlight is obtained by using characteristic data on light emitting devices (LED) stored in a memory. As characteristic data, the estimated light quantity can be obtained by measuring a luminance distribution of the whole area of the backlight under a plurality of temperature conditions. Or, the estimated light quantity can be obtained by calculating a luminance distribution of the whole area of the backlight from characteristic data of the individual light emitting devices.

A target light quantity to be set is set so that a displayed image has a luminance distribution in a convex curve when a white or primary color is displayed. In other words, the luminance distribution in a displayed image is high in the center area and low at the peripheral area. The reason is as follows. On the assumption that when a human being views a displayed image, the viewer's attention is likely to concentrate on the center area, the luminance in the center area is increased, thereby improving a picture quality to the perceptual notion.

FIG. 1 is a basic block diagram of a signal processing unit in a display device according to the present invention. The light quantity emitted by the backlight (or a lighting unit) 10 is controlled with a transmittance control device 11 for each pixel by each liquid crystal device to thereby form an image on the display screen.

An estimated quantity in a displayed image by the lighting unit 10 is calculated by an estimated light quantity calculating unit 13. To set characteristic data of the lighting unit 10 in the estimated light quantity calculating unit 13, the lighting unit 10 and the estimated light quantity calculating unit 13 may be connected through a signal line indicated by a dotted line with an arrow as shown in FIG. 1.

A distribution of a maximum luminance of a displayed image corresponding to a maximum value in input image signals 16 is set by using a target light quantity setting unit 12. Another feature of the present invention is that a target light quantity is set so that a distribution of maximum luminance becomes a convex distribution in the displayed image.

To achieve a set target light quantity, signals 16 to drive the transmittance control units 11 are to be corrected by using the estimated light quantity obtained. For this purpose, correction coefficients are calculated in the matrix coefficient calculating unit 14 based on the target light quantity and the estimated light quantity, and by using correction coefficients, the matrix operation unit 15 carries out a correction process on input image signals 16.

In other words, input image signals 16 are subjected to a correction process by a correction section 18, including the target light quantity setting unit 12, the estimated light quantity calculating unit 13, the matrix coefficient calculating unit 14, and the matrix operation unit 15.

Input image signals are combinations of at least three kinds of color signals, represented in an optional signal form, and in a correcting process of those color signals, arithmetic operations are carried out on image signals represented by signal combinations mentioned above. To show concrete examples, XYZ values represented in an XYZ calorimetric system or optional signals convertible into XYZ values are used.

In the present invention, basically, three kinds of variables XYZ represented in the XYZ calorimetric system which takes into consideration the wavelength distribution characteristics of human visual perception. Furthermore, three kinds of color signals RGB represented in the RGB calorimetric system may be used, which are obtained by coordinate transformation from XYZ coordinates.

Description will now be made of differences in some light emission distributions by the backlight. With display devices that have a backlight that emits light from each pixel, such as CRT or PDP, luminance irregularity between pixels is likely to occur. However, because the size of pixels is very small with respect to a displayed image, the luminance irregularity is often not perceptible to the human eye. With liquid crystal displays using a fluorescent lamp as the backlight, the luminance irregularity of a fluorescent lamp occurs. However, because the fluorescent lamp has the same length as the display screen and the backlight is provided with an optical structure, such as a scatter plate, the irregularity is less likely to be perceived visually.

On the other hand, the LED chip is larger than the pixels and smaller than the display screen and may be said to be intermediate between these two types of display described above. Therefore, the backlight by LED chips has a structure that a periodic irregularity easily perceptible to the human eye tends to occur.

So, description will be made of a case that for the backlight, three kinds of LEDs for RGB are used as the light emitting devices that have at least three dominant wavelengths. In a backlight using LED, there is irregularity in the light quantity distribution caused by an optical structure configured to convert point light sources into a surface light source and there is another irregularity in the distribution and the intensity of light emission wavelengths resulting from the semiconductor devices. Since these two kinds of irregularity are variables independent to each other, in a backlight formed by combining a plurality of LED chips, it is difficult to obtain uniform characteristics in the plane of the backlight. If the irregularity of lighting is noticed by the human eye, this means that the image quality has degraded. To express the irregularity numerically, the irregularity can be related to the image degradation by using a coordinate system based on human visual sense characteristics.

It is obvious that the lighting irregularity of the backlight should be quantified at least three values from the facts that the visual sense characteristics have three kinds of wavelength sensitivity characteristics, that at least three primary colors are required to represent color images, that image signals are made by three color signals of RGB (or XYZ), and so on. In other words, the lighting irregularity cannot be quantified by less than or equal to two values.

As one of the coordinate systems based on the human visual sense, there is the XYZ calorimetric system established by CIE. XYZ are values calculated based on three kinds of wavelength sensitivity characteristics that the human visual sense possesses, which are called the color-matching functions. When the light distribution in the plane of the backlight is converted into characteristics perceptible to the human visual sense, it is possible to use three values XYZ represented in the XYZ calorimetric system or xyZ (xy that represent the chromaticity, and Y that represents the luminance) obtained by conversion from XYZ). By setting a correspondence relation between these three values and RGB signals for driving the display device, in other words, by driving the display device by using results calculated in signal processing, the lighting irregularity can be alleviated.

The present invention, as shown in FIG. 1, includes an estimated light quantity calculating unit 13 for calculating estimated light quantity in the light emission distribution of the lighting unit 10 and a target light quantity setting unit 12 for setting target light quantity of a target light emission distribution, and realizes irregularity correction by signal processing. The estimated light quantity calculating unit 13 and the target light quantity setting unit 12 are described below.

The form of a light emission distribution of a representative LED in the lighting unit 10 is stored by the estimated light quantity calculating unit 13 according to the present invention, and by adding up the light emission distributions of the LED chips arranged at a plurality of locations, the estimated light quantity of the whole area of the lighting unit 10 is calculated.

This lighting unit 10 includes a combination of a plurality of LEDs to form a surface light source to illuminate a whole display screen. A majority of the LEDs have an angle-dependent light emission characteristic that, for example, light in the front direction is brightest and becomes darker as the LEDs go towards the peripheral area. The smaller the LED the greater arbitrariness it has with which it is disposed.

For the reasons described above, as shown at (1) in FIG. 2, in a surface light source formed by combining a plurality of LEDs, luminance irregularity occurs in a displayed image. The presence of irregularity suggests that there exist a plurality of local minimum points in the light quantity distribution in the displayed image as shown at (1) in FIG. 2. What has been described about the minimum points may be said of the dominant wavelengths of the individual LEDs.

To prevent the above problem to realize uniform surface light emission, there is a method of using an optical device which sufficiently mixes the light rays from the light emitting devices. For example, by using a diffusing plate, the angle-dependent property can be reduced. However, the operation principle of this method is to increase the reflection and refraction of light to thereby mix light rays, and in order to realize a lighting uniformity by reflection and refraction, an optical path of some size is required, thus increasing the thickness of the lighting unit.

With regard to the structure of the lighting unit 10, light concentrates from all directions in the center area in the light distribution, whereas the peripheral area is limited in directions from which light comes from. Therefore, in the display of a structure such as this, as shown by the dotted line at (2) in FIG. 2, the luminance distribution in the plane is high in the center area and low in the peripheral area. If it is intended to achieve a uniform luminance distribution in a displayed image, there is no other way but to perform signal processing in a manner to adjust the whole area to the luminance at the peripheral area as indicated by a solid line at (2) in FIG. 2. In this case, it is impossible to make effective use of the luminance of the center area higher than in the peripheral area.

Figure 2:
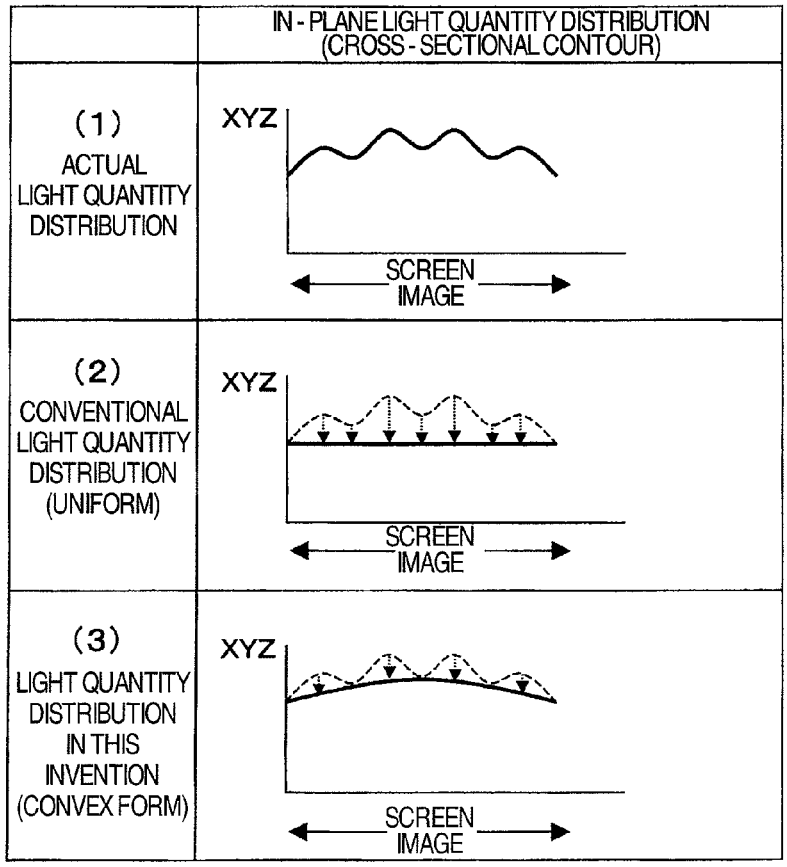
FIG. 2 is a diagram for explaining setting of a target light quantity distribution.

Therefore, by using the target light quantity setting unit 12 according to the present invention, a target is set so that the luminance distribution in a displayed image is high at the center and low in the peripheral area, more specifically, so that the luminance in the displayed image has a convex characteristic with minimum points located at both sides of the displayed image as shown at (3) in FIG. 2. By making use of the viewers' tendency to visually focus on the center area rather than the peripheral area, the luminance of the center area is at a relatively high level. By this setting, the minimum points existing in the actual luminance distribution are eliminated so that image degradation perceptible to the eyes can be prevented as shown by the dotted line at (3) in FIG. 2.

Because the light emission distribution of a fluorescent lamp in wide use as the light source of the backlight has a plurality of peaks and its waveform is complicated, it is difficult to numerically express the light irregularity easily.

However, the semiconductor devices, such as LED, have a distribution characteristic close to a normal distribution centering around one dominant wavelength. Therefore, the light emission distribution characteristic in a steady condition can be represented by three characteristics, a dominant wavelength, a full-width half maximum, and a height. To emit three primaries RGB, it is necessary to provide LEDs with three dominant wavelengths. Among a group of LEDs of the same product number (or product name), which are supposed to have the same dominant wavelength, there is LED-to-LED variation in characteristics and characteristics vary with operating conditions. The main causes of variation are driving voltage and current, and operation elapsed time and temperature, among others.

On the other hand, if the transmitted wavelength distribution of color filters added to the liquid crystal devices is wider than the light emission wavelength distribution of the LEDs, the light emission wavelength distribution of the LEDs is not intercepted by the color filters but output to a displayed image. Though the emission wavelength distribution is affected by the material disposed between the backlight, because the basic wavelength distribution is preserved, changes in the LED characteristics can be observed on a displayed image. Since the chromaticity of the LEDs basically coincides with the chromaticity of the displayed image, chromaticity changes between them agree with each other.

Figure 3A:
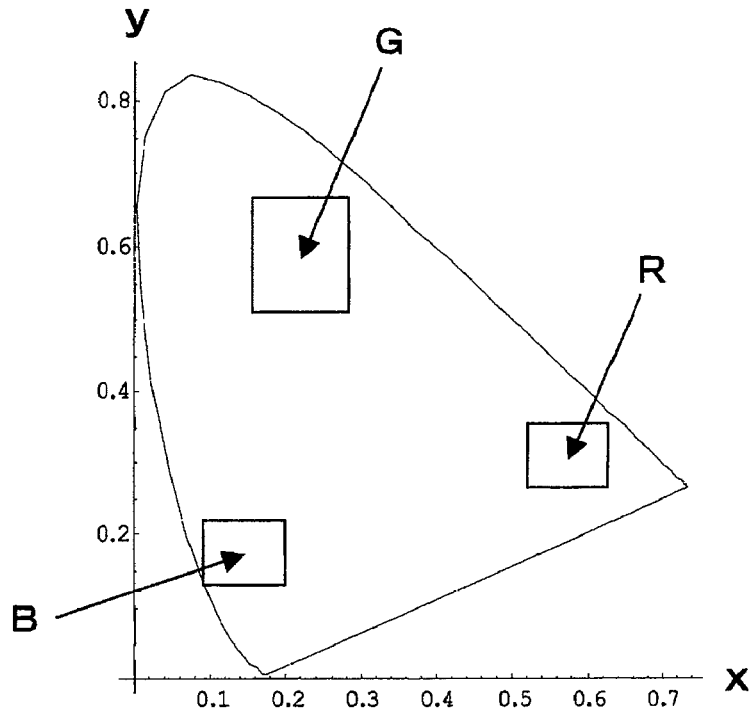
FIG. 3A is a diagram for explaining chromaticity variation of a semiconductor light emitting device.

The visualization based on wavelength distribution can be expressed by plotting as points on a (xy) chromaticity distribution diagram as shown in FIG. 3A, and LEDs emitting three primary colors RGB of different dominant wavelengths can be plotted at different points R, G, and B. In the LEDs emitting dominant wavelengths corresponding to R, if there is variation in the dominant wavelengths of light in some LEDs of a certain production lot, the primary colors are plotted at points in areas with some breadth as indicated by squares in FIG. 3A on the (xy) chromaticity distribution diagram. Similarly, even with some LEDs emitting dominant wavelengths of light corresponding to G and B, the chromaticity distribution is such that the primary colors are plotted in some areas as indicated by the squares in FIG. 3A.

Figure 3B:
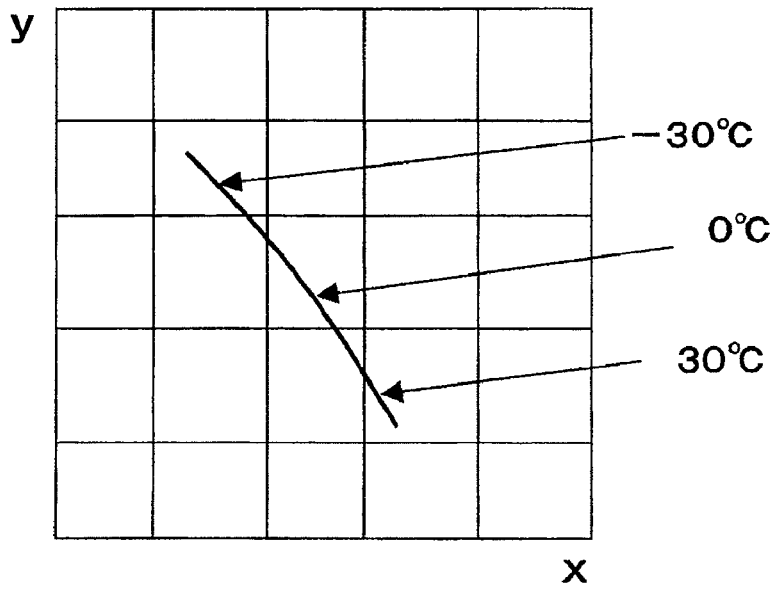
FIG. 3B is a diagram for explaining chromaticity variation of a semiconductor light emitting device.

If the light emission wavelength distribution varies depending on temperature, a single LED is plotted at different points on the (xy) chromaticity diagram as shown in FIG. 3B. If a single LED chip is plotted as points on the (xy) chromaticity diagram using temperature as a parameter, a locus is traced as shown in this figure.

In this invention, in an LED backlight that emits at least three kinds of primary colors, in one group of the LEDs of each of the three primary colors, LEDs of the same product number or the same product name but of different dominant wavelengths are used. Further, in this invention, the light emitting devices whose characteristics vary with temperature are used.

For this reason, in the present invention, by using the matrix operation unit 15 shown in FIG. 1, RGB signals for driving the transmittance control units (or liquid crystal panel) 11 are corrected. By this correction, it is possible to reduce changes in chromaticity of a displayed image at the liquid crystal panel 11 than changes in chromaticity of the LEDs at the backlight 10. To realize the above idea, the target light quantity setting unit 12 shown in FIG. 1 sets a color gamut that can be displayed at the light emitting devices where a dominant wavelength is distributed as a target color gamut.

The estimated light quantity of the backlight which is output by the estimated light quantity calculating unit 13 shown in FIG. 1 can be previously obtained by taking a photo of the backlight with a camera, for example. By having previously prepared photographing data of the backlight under various condition settings and winkling out the photographying data based on actual working conditions, it is possible to estimate light quantity of an actual backlight. For this purpose, it is only necessary to provide a table-form memory associated with the conditions of the backlight and having shooting data written in the table as characteristic data. The conditions to be set may include temperature, operation cumulative time, or the like.

Figure 4:
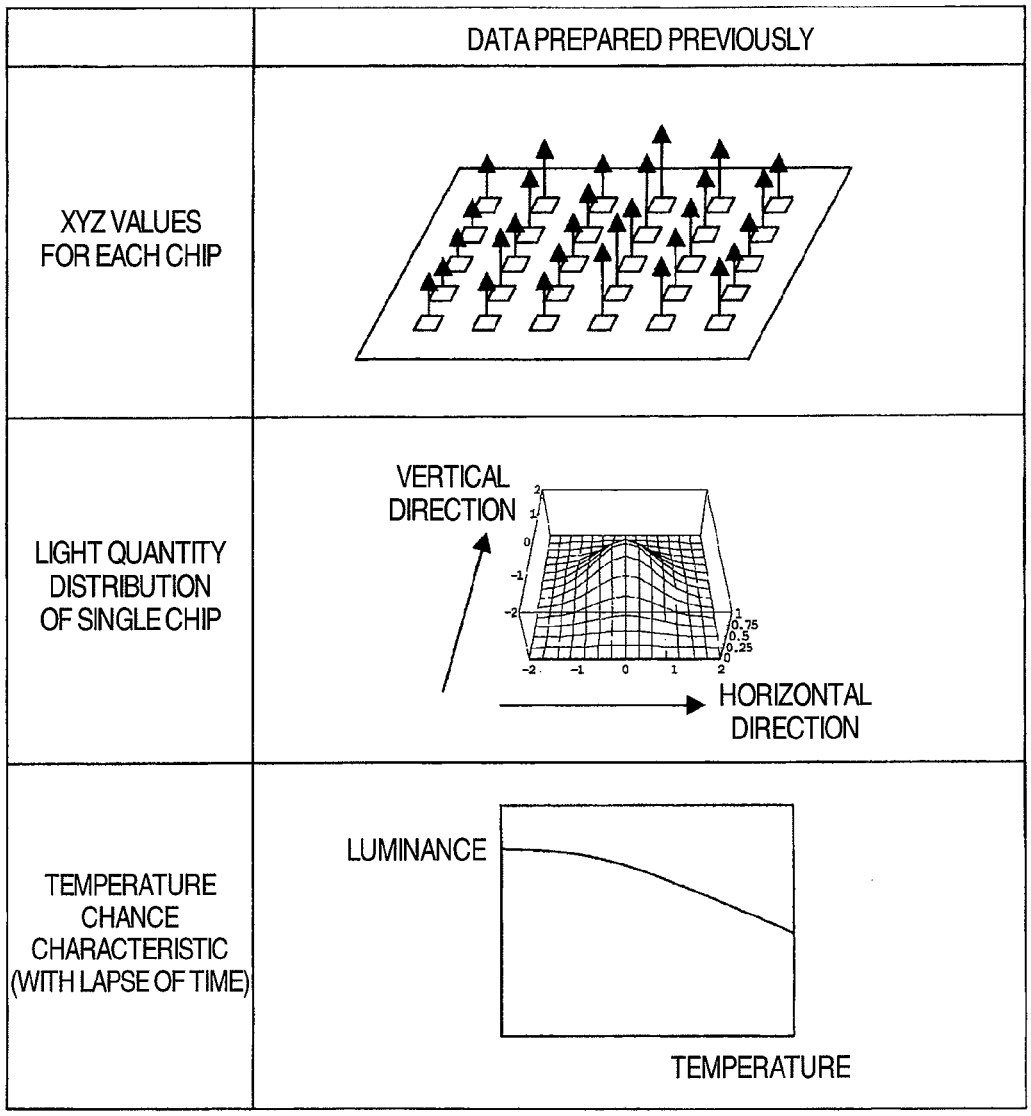
FIG. 4 is a diagram for explaining data used in estimating a light quantity distribution.

Or, as shown in FIG. 4, characteristic data on individual parts which form the backlight is prepared as shown in FIG. 4. And, by taking out separate data based on actual working conditions, it is possible to combine various data to calculate a quantity of the whole area of a backlight. Thus, it is possible to estimate light quantity of an actual backlight.

For this purpose, individual items of characteristic data, such as the voltage, current, temperature and XYZ data of LED chips are written in a table-form memory. Also, contour lines of a light quantity distribution of the LED chips should be prepared. If preparations such these are made, by adding up XYZ light quantity distributions of all LED chips in a displayed image, it becomes possible to calculate the estimated light quantity of a light quantity distribution in the displayed image.

Figure 5:
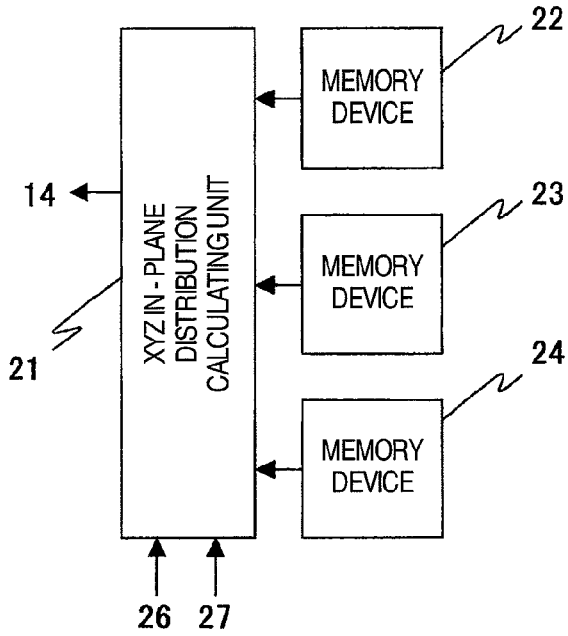
FIG. 5 is a block diagram of an estimated light quantity calculating unit 13.

FIG. 5 shows a block diagram of the operation of the estimated light quantity calculating unit 13, shown in FIG. 1, for calculating a light quantity distribution of the whole area of an actual backlight from characteristic data including the individual items mentioned above. It is necessary to prepare a memory device 22 for storing light emission characteristics (XYZ values, for example) of individual light emitting devices shown in FIG. 4, such as LEDs that form a backlight and a memory device 23 for storing a representative light quantity distribution of a single light emitting device shown in FIG. 4. And data is previously written in those memory devices.

An XYZ in-plane distribution calculating unit 21 calculates a light quantity distribution in the plane of the backlight based on data in the memory devices 22 and 23. For example, by multiplying a light quantity distribution of each single chip by a light emission characteristic (X) of each chip, it is possible to calculate a light quantity distribution of an in-plane light emission characteristic (X) by the chips. A plane memory, not shown, is prepared, and a calculation result is written in a memory address corresponding to a location where the chip is disposed and a distribution range of the chip. In the same manner, a light quantity distribution is calculated for each of the remaining chips and calculation results are added one result after another to the contents of the plane memory until results of all chips are added.

As described above, a contribution amount to a backlight light quantity distribution can be calculated for all chips that form the backlight and the contribution amounts can be added up, so that a total sum is taken as the estimated light quantity of the backlight light quantity distribution. By setting a pixel location 26 to the XYZ in-plane distribution calculating unit 21, the estimated light quantity can be output to that pixel location. For example, the pixel locations 26 may be set in such a way as to scan the in-plane region.

Further, chip characteristics can be corrected based on conditions, such as the temperature and operation cumulative time of the backlight. For example, as shown in FIG. 5, a memory device 24 is provided for previously storing relations among characteristics, temperature and elapsed time of the chips. By reading data from the memory device 24 by using a measured value 27 obtained by a measuring instrument, such as a sensor, XYZ values of each chip are modified.

The calculations described above are carried out at one-frame periods or at periods of certain number of frames. By performing calculations for each pixel or every certain number of pixels, calculation load can be mitigated. Calculation results are stored in a memory, not shown, and read at required timing.

In the manner as described, XYZ values by the lighting unit 10 shown in FIG. 1 at the pixel locations in a displayed image can be obtained, and matrix coefficients have only to be calculated so that the primary color points by those XYZ values may become uniform in the plane.

Figure 6:
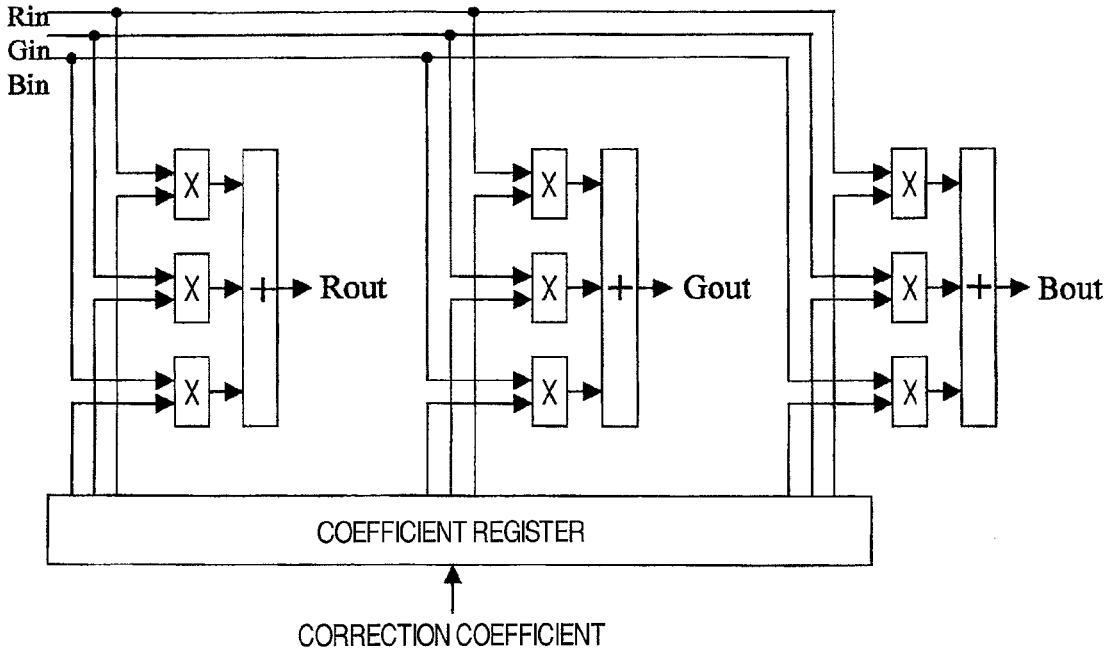
FIG. 6 is a block diagram of a unit 15.

FIG. 6 shows a circuit diagram for matrix operation by inputting three kinds of color signals 16 to the matrix operation unit 15 shown in FIG. 1, and outputting three kinds of color signals as computation results. In a matrix operation of three inputs and three outputs as described, interactions among color signals are expressed by nine coefficients. In the present invention, coefficients are set to correct variations between pixels of the backlight.

A concrete structure of a system for executing matrix operations is configured not in a limitative form but may be a so-called pipeline structure with circuits capable of carrying out all arithmetic operations or otherwise software may be used.

A procedure for calculating correction coefficients of the matrix coefficients calculating unit 14 will be described using an equation (1) as follows.

Equation (1)

$$\begin{bmatrix} Xrt & Xgt & Xbt \\ Yrt & Ygt & Ybt \\ Zrt & Zgt & Zbt \end{bmatrix} \cdot \begin{bmatrix} R \\ G \\ B \end{bmatrix} = \begin{bmatrix} Cxx & Cyx & Czx \\ Cxy & Cyy & Czy \\ Cxz & Cyz & Czz \end{bmatrix} \cdot \begin{bmatrix} Xrin & Xgin & Xbin \\ Yrin & Ygin & Ybin \\ Zrin & Zgin & Zbin \end{bmatrix} \cdot \begin{bmatrix} R \\ G \\ B \end{bmatrix} \quad (1)$$

The left side of equation (1) is a relational expression that outputs display characteristics XYZ as targets from input RGB signals. The right side of equation (1) is a relational expression of a multiplication of light emission characteristics XYZ by the input RGB signals by a correction coefficient C. The coefficient C is calculated so that both sides become equal.

For example, by allocating RGB signals to 0 (minimum signal) or 1 (maximum signal), the equation can be simplified into simultaneous equations. It is easy to obtain a coefficient C by solving simultaneous equations.

The targets XYZ to be set on the left side are set so that they are in the ranges of chromaticity distribution that can be displayed in the presence of variation among the LED chips. For the luminance Y, a target is set for each pixel so that the distribution is in a convex form in the plane. By using a correction coefficient C obtained by setting targets as described, input image signals are corrected to thereby eliminate color irregularity.

Figure 7:
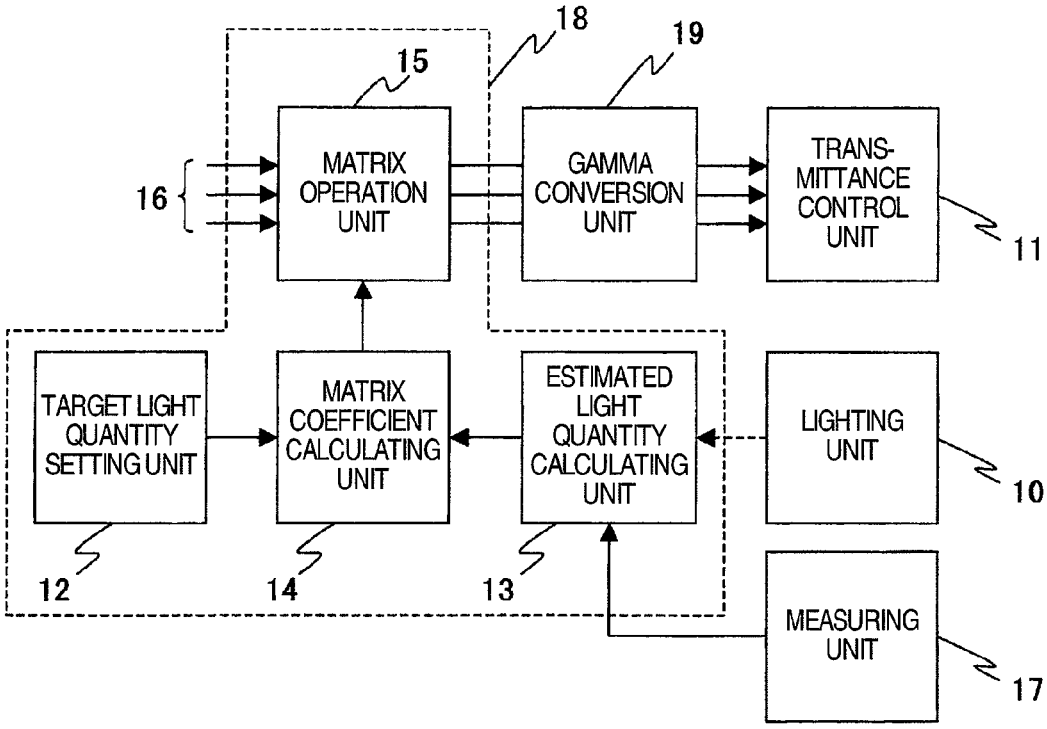
FIG. 7 is another basic block diagram of the present invention.

In the basic block diagram shown in FIG. 1, if the transmittance control units 11 are formed in the liquid crystal panel. It is desirable to multiply output of the matrix operation unit 15 by the input/output characteristics, in other words, the non-linear characteristic (gamma characteristic) of the liquid crystal devices. For this purpose, as shown in FIG. 7, a gamma conversion unit 19 is disposed between the matrix operation unit 15 and the transmittance control units 11 to convert the signals.

The method of multiplying by a gamma characteristic or releasing it is not limitative but a conversion table or function multiplication may be used in a digital signal process, or a resistance ladder circuit or a function generating circuit using an OP Amp may be used in an analog signal process.

To feed back the operation of the lighting unit 10, this can be realized by providing a measuring unit 17 for temperature, luminance, current, voltage or an operation cumulative time, and sending a returned signal. By sending a returned signal to, for example, the estimated light quantity calculating unit 13 in the correction section 18, it becomes possible to calculate a light emission distribution that reflects the operating condition of the LED chips.

The matrix operation unit 15 in the present invention may be used also as a so-called color signal conversion process. For example, like RGB signals and XYZ signals, those color signals, which are convertible to other signals but are defined otherwise, are originally directed to a color signal conversion process, but may be also subjected to signal processing at the matrix operation unit 15. Therefore, those color signals undergo a color signal conversion process, and simultaneously get irregularity correction coefficients reflected thereto. In other words, color signals can be subjected to a color signal conversion process and an irregularity correction process at the same time.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device, comprising:

lighting means including a plurality of light emitting devices with different dominant wavelengths in a wavelength distribution;

transmittance control means for enabling a displayed image including a plurality of transmittance control devices for controlling light quantity from said lighting means; and correcting means for correcting input image signals;

wherein said correcting means includes:

target light quantity setting means for setting a target light quantity on the displayed image at a maximum signals, estimated light quantity calculating means for calculating an estimated light quantity from light emitting devices at a maximum signal, matrix coefficient calculating means for calculating matrix coefficients based on said target light quantity and said estimated light quantity, and matrix operation means for correcting the input image signals by said matrix coefficients and operates said transmittance control means;

wherein a chromaticity distribution of said plurality of light emitting devices is wider than primary colors displayed by said transmittance control devices;

wherein said plurality of light emitting devices have at least three kinds of dominant wavelengths;

wherein said plurality of light emitting devices includes a plurality of red LEDs, a plurality of green LEDs and a plurality of blue LEDs;

wherein a chromaticity of each red LED of said plurality of red LEDs, a chromaticity of each green LED of said plurality of green LEDs and a chromaticity of each blue LED of said plurality of blue LEDs has a variation; and wherein said matrix operation means reduces changes in chromaticity of the displayed image at said transmittance control means rather than reducing changes in chromaticity of said plurality of light emitting devices at said light emitting means.

2. The display device according to claim 1, wherein said estimated light quantity calculating means includes first storing means for storing light emission characteristics of each light emitting device; second storing means for storing a light quantity distribution of light emitting devices; and in-plane distribution calculating means for calculating a light emission distribution of a whole displayed image based on said light emission characteristics and said light quantity distribution, and wherein the display device comprises converting means for multiplying by a non-linear characteristic between said matrix operation means and said transmittance control means.

3. A display device according to claim 1, wherein said correcting means corrects the input image signals to differentiate between minimum points in a luminance distribution in said lighting means and minimum points in a luminance distribution in said displayed image to thereby eliminate minimum points existing in the luminance distribution of said lighting means.

4. A display device according to claim 1, wherein said correcting means corrects the input image signals to differentiate between minimum points in a luminance of the dominant wavelengths of said light emitting devices and minimum points in a luminance distribution of said displayed image to thereby eliminate minimum points existing in the luminance distribution of the lighting means.

5. The display device according to claim 1, wherein said estimated light quantity calculating means includes storing means for storing temperature and elapsed time of said light emitting devices.

6. A display device according to claim 1, wherein said target light quantity setting means, in a luminance distribution of said transmittance control means in a two-dimensional plane, sets the luminance distribution to be high in a center of said transmittance control means and sets the luminance distribution to be low in a peripheral area of said transmittance control means.

7. A display device according to claim 1, wherein said matrix operation means sets said chromaticity of said plurality of light emitting devices so that the chromaticity is within ranges of chromaticity distribution which are displayable for said transmittance control means.

8. A display device according to claim 1, wherein said target light quantity setting means sets light quantity with a convex characteristic in a displayed image, and wherein said matrix operation means drives said transmittance control means by converting the input image signals formed by a plurality of kinds of color signals.

9. A display device according to claim 1, wherein said estimated light quantity calculating means calculates estimated light quantity at each pixel location by said lighting means, and wherein the display device further comprises measuring means for transmitting a returned signal for reflecting an operation of said lighting means, to said correcting means.

* * * * *